US006886428B1

(12) United States Patent
Hsien

(10) Patent No.: US 6,886,428 B1
(45) Date of Patent: May 3, 2005

(54) PAWL CONTROL MECHANISM FOR A RATCHET TOOL

(76) Inventor: Chih-Ching Hsien, No. 367, Pei Yang Rd., Feng Yuan, Taichung (TW)

( * ) Notice: Subject to any disclaimer, the term of this patent is extended or adjusted under 35 U.S.C. 154(b) by 18 days.

(21) Appl. No.: 10/771,438

(22) Filed: Feb. 5, 2004

(51) Int. Cl.[7] ..... B25B 13/46
(52) U.S. Cl. ..... 81/63.2; 81/63
(58) Field of Search ..... 81/60–63.2

(56) References Cited

U.S. PATENT DOCUMENTS 968,080 A * 8/1910 Repass ..... 81/63.1
4,336,728 A * 6/1982 Deibert ..... 81/62
6,516,692 B1 * 2/2003 Hsien ..... 81/63.2
6,609,444 B1 * 8/2003 Hsien ..... 81/63.2
6,761,091 B2 * 7/2004 Hsien ..... 81/63.2
2003/0010159 A1 * 1/2003 Hu ..... 81/63.2

* cited by examiner

*Primary Examiner*—David B. Thomas

(57) ABSTRACT

A control mechanism for a ratchet tool includes a switch pivotably received in a chamber in the head of the tool and a pawl is received in a recess so as to be matched with a gear wheel in the head. The pawl is located at located at a mediate portion of a depth of the chamber in the head. The switch has two holes in each of which a pushing member a spring are received. The pushing member is received in the hole and covered by an inside of the chamber when the switch is not pivoted. The user may push either one of two ends of the pawl toward the chamber to shift one of the pushing members to be in alignment with one of the convex portions. The pushing member that is shifted pushes the convex portion and pivots the pawl to be matched with the gear wheel.

5 Claims, 6 Drawing Sheets

PAWL CONTROL MECHANISM FOR A RATCHET TOOL

FIELD OF THE INVENTION

The present invention is a pawl control mechanism that includes a switch which is pushed at either one of two ends toward the chamber in the head of the tool to position the pawl.

BACKGROUND OF THE INVENTION

Three conventional ratchet tools that are known to applicant are disclosed respectively in U.S. Pat. No. 6,516,692 B1, U.S. Pat. No. 6,609,444 B1, and US-2003/0010159 A1. Each of the disclosed ratchet tools of the prior art involves a switch which controls the movement of the pawl for deciding the direction that the gear wheel when output a torque by rotating the tool. The switch of the U.S. Pat. No. 6,516,692 B1, U.S. Pat. No. 6,609,444 B1 are moved parallel to the surface of the head of the ratchet tool to move the pawl. The switch of US-2003/0010159 A1 is rotated an angle about a shaft and the rotational movement is happened on the surface of the head of the ratchet tool. In other words, the user operates the switch member of the three conventional ratchet tools in a plain that is parallel to the surface of the head of the tool. This action is not convenient when the user's finger is attached with grease.

The present invention intends to provide a pawl control mechanism for a ratchet tool wherein the switch is operated by pushing either one of two ends of the switch toward the head of the tool.

SUMMARY OF THE INVENTION

The present invention relates to a ratchet tool which comprises a head and a gear wheel is rotatably received in a hole in the head and a recess for receiving a pawl therein is defined in an inner periphery of the hole. The pawl has a toothed surface in a first end thereof so as to be matched with a toothed outer periphery of the gear wheel. Two convex portions extend from two ends of a second end of the pawl.

A chamber is defined in a side of the head and a switch is pivotably received in the chamber. The recess is in communication with the chamber and located at a mediate portion of a depth of the chamber. The switch has an insertion which is pivotably received in the chamber and an operation plate is located on an end of the insertion and each one of two ends of the operation plate can be pushed toward the chamber to pivot the insertion. Two holes are defined in the insertion and located from a distance from the recess when the switch is not pivoted. Each hole in the insertion has a pushing member and a spring received therein. The pushing member is biased by the spring and sized to be received in the hole by an inside of the chamber. The two pushing members are alternatively shifted to a position in alignment with one of the convex portions of the pawl so that one of the convex portions of the pawl is pushed toward the gear wheel.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
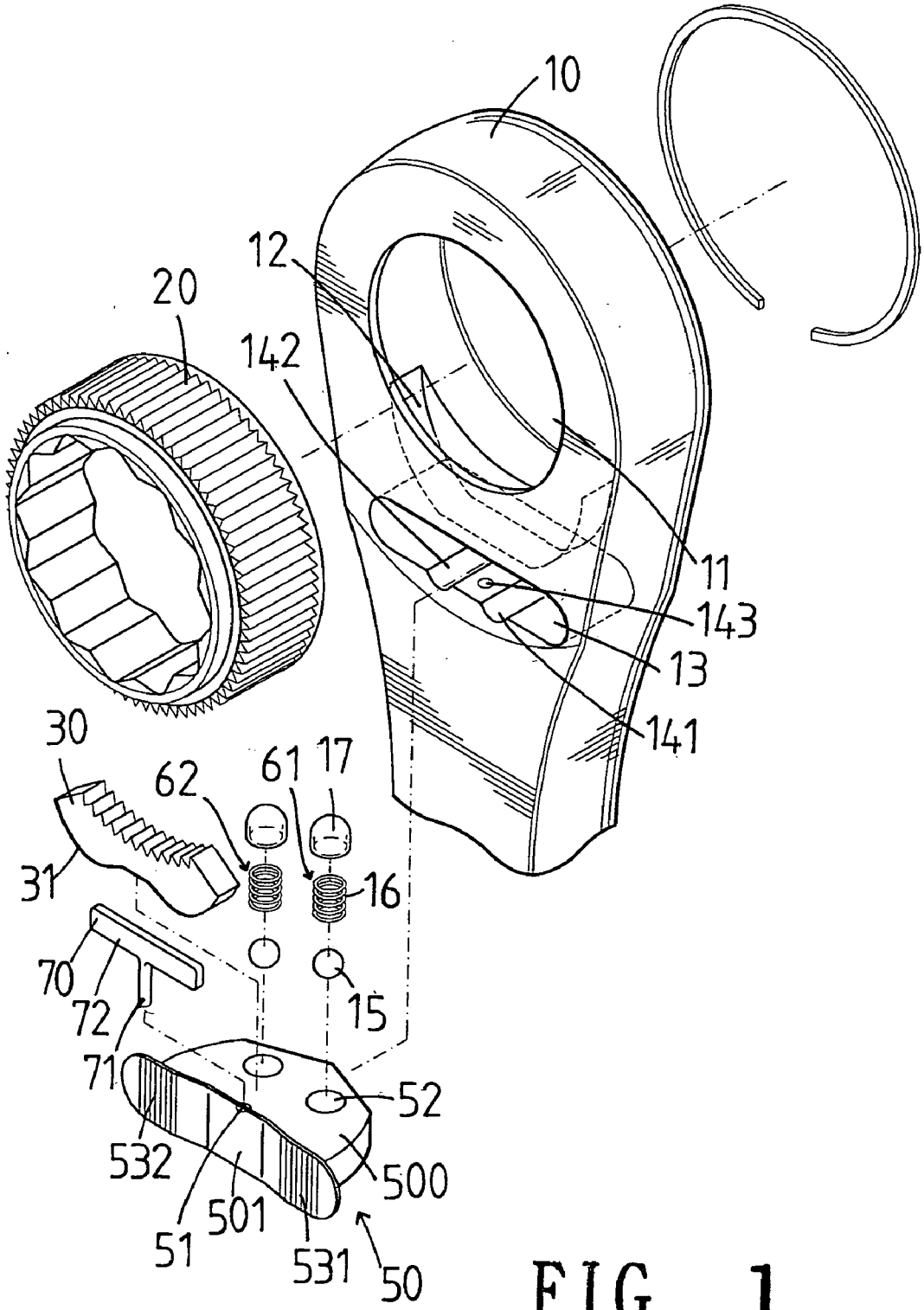
FIG. 1 is an exploded view to show the ratchet tool of the present invention.
Figure 2:
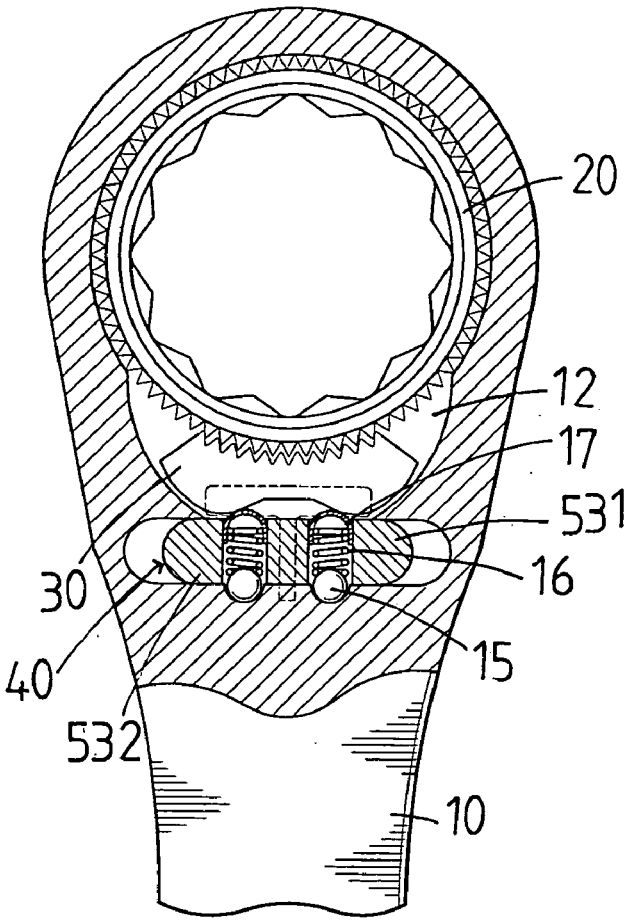
FIG. 2 is a cross sectional view to show the ratchet tool of the present invention, wherein the switch is not pivoted.
Figure 3:
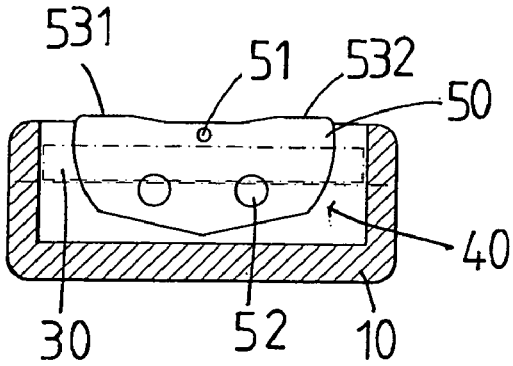
FIG. 3 is an end cross sectional view to show that the switch is not yet pivoted.
Figure 4:
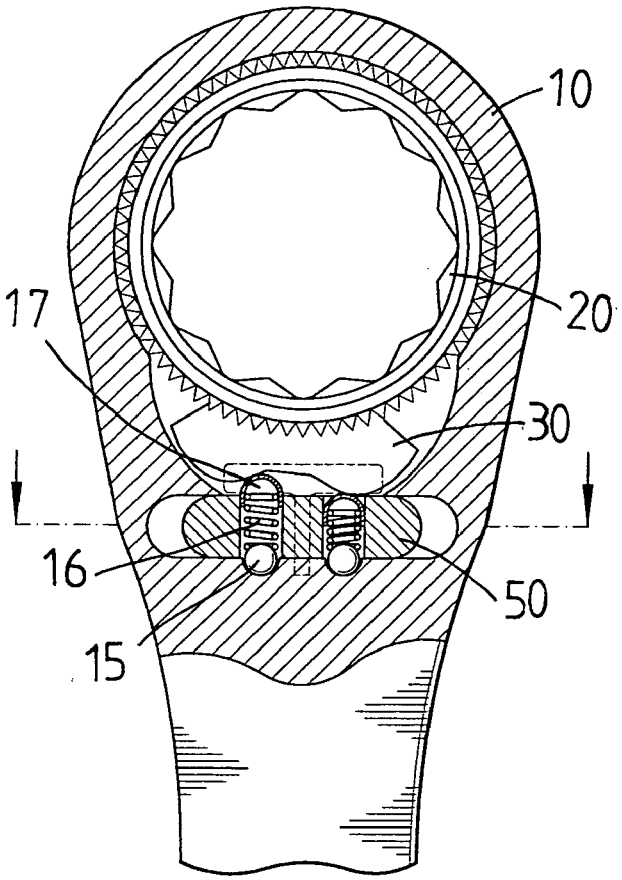
FIG. 4 is a cross sectional view to show the ratchet tool of the present invention, wherein the switch is pivoted by pushing on one of two ends thereof.
Figure 5:
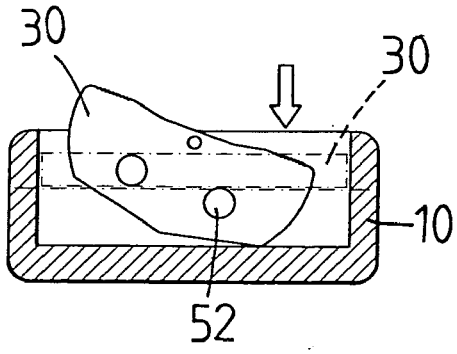
FIG. 5 is an end cross sectional view to show that the switch is pivoted due to the action disclosed in FIG. 4.
Figure 6:
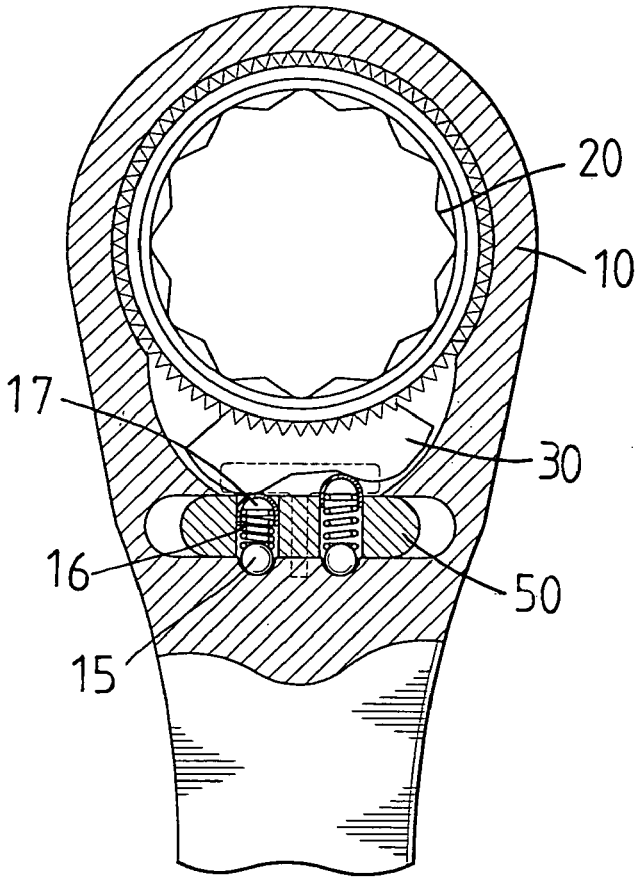
FIG. 6 is a cross sectional view to show the ratchet tool of the present invention, wherein the switch is pivoted by being pushed on the other one of two ends thereof.
Figure 7:
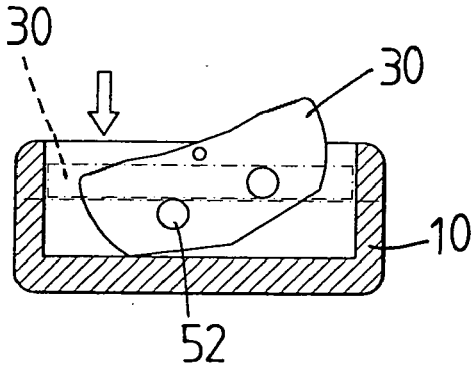
FIG. 7 is an end cross sectional view to show that the switch is pivoted due to the action disclosed in FIG. 6.

Referring to FIGS. 1 to 3 and 9, the ratchet tool of the present invention comprises a head 10 having a hole 11 defined through and a gear wheel 20 is rotatably received in the hole 11. A recess 12 is defined in an inner periphery of the hole 11 and a pawl 30 is received in the recess 12. The pawl 30 has a toothed surface in a first end thereof so as to be matched with a toothed outer periphery of the gear wheel 20. Two convex portions 31 extend from two ends of a second end of the pawl 30.

Figure 8:
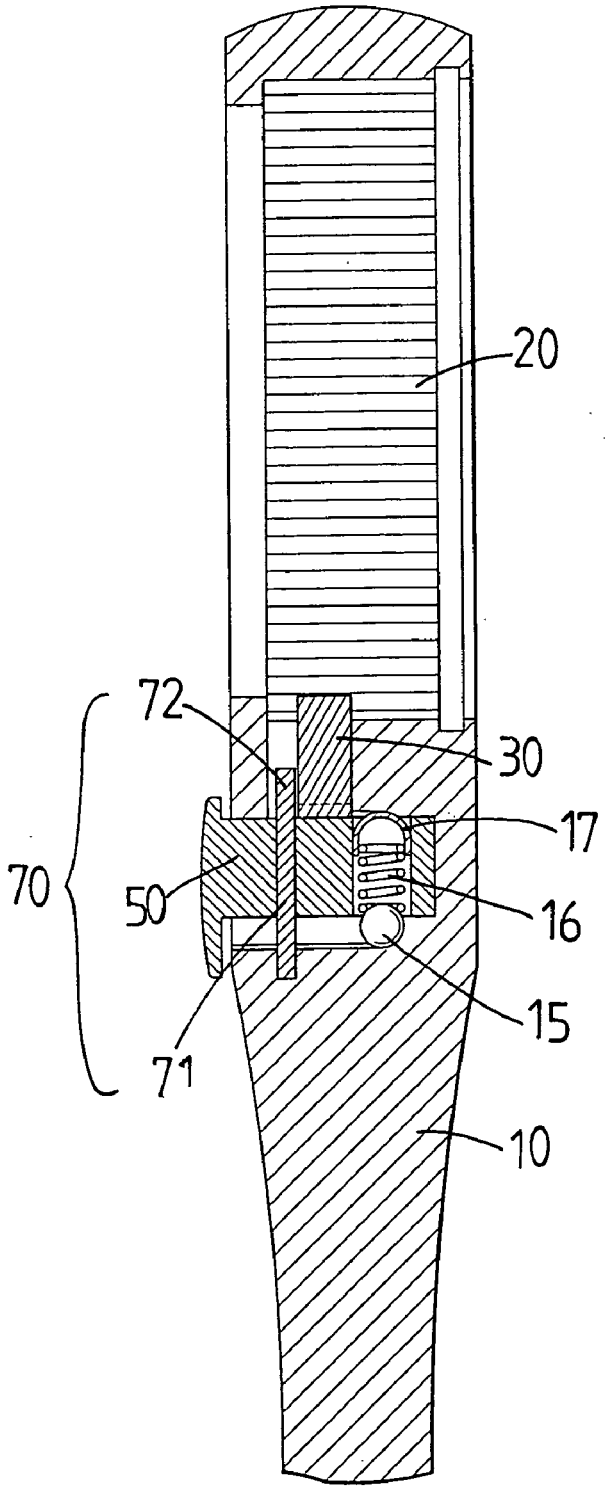
FIG. 8 is a side cross sectional view to show the ratchet tool of the present invention.
Figure 9:
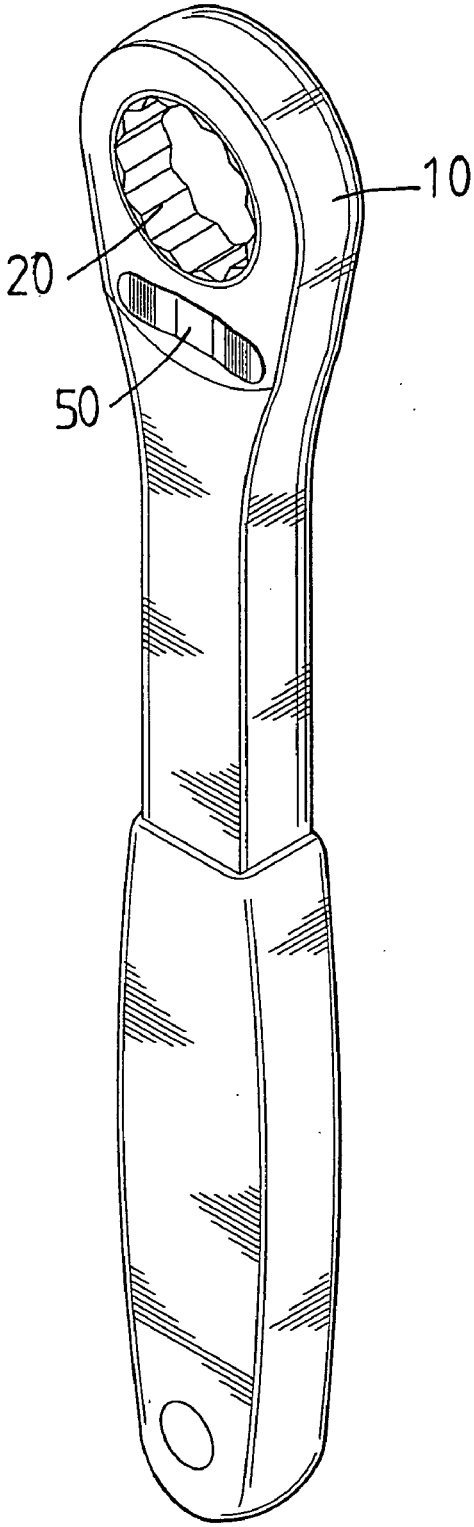
FIG. 9 is a perspective view of the ratchet tool of the present invention.

A chamber 13 is defined in a side of the head 10 and communicates with the recess 12 which is located at a mediate portion of a depth of the chamber 13 as shown in FIG. 8. Two notches 141, 142 and a positioning hole 143 are defined in the inside of the chamber 13 wherein the positioning hole 143 is located between the two notches 141, 142. A switch 50 composed of an insertion 500 and an operation plate 501 is pivotably received in the chamber 13 by a pin 70 which extends through a pin hole 51 in the insertion 500 which is inserted in the chamber 13 and is engaged with the positioning hole 143 in the chamber 13. The pin 70 is a T-shaped member and includes a horizontal portion 72 and an upright vertical portion 71 which extends through the pin hole 51, the horizontal portion 72 is located beside a side the pawl 30. The operation plate 501 is located on an end of the insertion 500 and accessible form an outside of the head 10. Each one of two ends 531, 532 of the operation plate 501 can be pushed toward the chamber 13 to pivot the insertion 500.

Two holes 52 are defined through in the insertion 500 and located from a distance from the recess 12 when the switch 50 is not pivoted as shown in FIG. 8. Each hole 52 in the insertion 500 has a pushing member 17, a spring 16 and a bead 15 received therein. The pushing member 17 and the bead 15 are biased by two ends of the spring 16. The pushing member 17 is sized to be received in the hole 52 by an inside of the chamber 13 when the switch 50 is not pivoted as shown in FIG. 8. The chamber 13 further includes two elongate notches 141, 142 so that the beads 15 are movable in the notches 141, 142 when the switch 50 is pivoted.

FIGS. 4 to 7 show that the two pushing members 17 are alternatively shifted to a position in alignment with one of the convex portions 31 of the pawl 30. When either one of the pushing members 17 is shifted to a position to push one of the convex portions 31 of the pawl 30 toward the gear wheel 20, the pawl 30 is positioned to match with the gear wheel 20.

The switch 50 is operated by pushing either of the two ends 531, 532 toward the chamber 13 so as to position the pawl 30. The switch 50 is easily to be operated regardless of the condition of the finger of the user and this is especially advantage for the user whose fingers are attached with grease.

While we have shown and described the embodiment in accordance with the present invention, it should be clear to those skilled in the art that further embodiments may be made without departing from the scope of the present invention.

What is claimed is:

1. A ratchet tool comprising:

a head having a hole defined through and a gear wheel rotatably received in the hole, a recess defined in an inner periphery of the hole and a pawl received in the recess, the pawl having a toothed surface in a first end thereof and the toothed surface matched with a toothed outer periphery of the gear wheel, two convex portions extending from two ends of a second end of the pawl, and a chamber defined in a side of the head and a switch pivotably received in the chamber, the recess being in communication with the chamber and located at a mediate portion of a depth of the chamber in the head, the switch having an insertion which is pivotably received in the chamber, an operation plate located on an end of the insertion and being accessible form an outside of the head, each one of two ends of the operation plate being pushed toward the chamber to pivot the insertion, two holes defined in the insertion and located from a distance from the recess when the switch is not pivoted, each hole in the insertion having a pushing member and a spring received therein, the pushing member being biased by the spring and being sized to be received in the hole by an inside of the chamber, the two pushing members being alternatively shifted to a position in alignment with one of the convex portions of the pawl and pushing one of the convex portions of the pawl toward the gear wheel.

2. The ratchet tool as claimed in claim 1, wherein the two holes are defined through the insertion of the switch and two notches are defined in the inside of the chamber, a bead engaged with one of the two notches and contacting the spring.

3. The ratchet tool as claimed in claim 2, wherein each of the notches are an elongate notch so that the beads are movable in the notches when the switch is pivoted.

4. The ratchet tool as claimed in claim 1, wherein a pin extends through a pin hole in the insertion and engaged with a positioning hole defined in the inside of the chamber, the positioning hole located between the two notches.

5. The ratchet tool as claimed in claim 4, wherein the pin is a T-shaped member and includes a horizontal portion and an upright vertical portion which extends through the pin hole, the horizontal portion located beside a side the pawl.

* * * * *